US006723006B1

(12) United States Patent
Lin

(10) Patent No.: US 6,723,006 B1
(45) Date of Patent: Apr. 20, 2004

(54) GOLF CLUB GRIP

(76) Inventor: Cheng-Tsung Lin, No. 3, Lane 396, Jungshan Rd., Rende Shiang, Tainan (TW)

( * ) Notice: Subject to any disclaimer, the term of this patent is extended or adjusted under 35 U.S.C. 154(b) by 0 days.

(21) Appl. No.: 10/281,212

(22) Filed: Oct. 28, 2002

(51) Int. Cl.[7] ..... A63B 53/14
(52) U.S. Cl. ..... 473/300
(58) Field of Search ..... 473/300–303, 473/549, 551, 568, 203, 204; D21/756; 74/551.9; 81/489; 16/421, 430

(56) References Cited

U.S. PATENT DOCUMENTS

2003/0045370 A1 * 3/2003 Jaw ..... 473/302

* cited by examiner

*Primary Examiner*—Stephen Blau
(74) *Attorney, Agent, or Firm*—Alan Kamrath

(57) ABSTRACT

A golf club grip includes a cylinder, a plurality of threads formed on in the outer surface of the cylinder, and a plurality of covers wound spaced apart around the cylinder. The threads have respectively a central thread body and two grooves respectively formed at two sides of each the central thread body. The anti-slipping bands are respectively wound around the threads. The covers respectively hide every section defined by every two neighboring threads. Then every two neighboring central thread bodies obstruct one side of two neighboring covers so that they may not be pressed to tip up by the hands of a user gripping the club grip in case of the golf club striking a golf ball. The cylinder, the anti-slipping bands and the covers may be colored different from one another.

1 Claim, 5 Drawing Sheets

(A)

(B)

(C)

GOLF CLUB GRIP

BACKGROUND OF THE INVENTION

This invention relates to a golf club grip, particularly to one provided with good tactile sense for gripping, good anti-slipping effect and a variety of colors.

Conventional golf club grips commonly have an elastic cylinder 1 fitted around on an upper portion of a golf club, as shown in FIG. 1, and a cover 2 wound on an outer surface of the elastic cylinder 1 as shown in FIG. 2. The cover 2 in the conventional golf club grip has an objective for special ornament, but it is often attached not evenly, having a thick portion caused by overlapping and a thin portion caused by empty spaces to result in a bad tactile sense for gripping or even easily fall of the elastic cylinder 1. The reason may be no clear target lines provided on the elastic cylinder 1 for the cover to be attached evenly. A user may be able to depend on one of two ends as a target line to wind the cover 2 helically around the elastic cylinder 1. The lengthwise edge of one round of the cover 2 is used as a target line for the next round of winding of the cover 2. However, the cover 2 may overlap with each other a little or separated from each other with some gaps in winding processing. Then the whole cover 2 may not be complete, with some places overlapping and some places empty. In addition, the cover must have an adhesive coated on an inner surface to stick on the outer surface of the elastic cylinder 1. Thus, once the cover is attached closely on the elastic cylinder 1, it is almost unable to be adjusted in its location on the cylinder 1.

If the conventional golf club grips have the cover 2 neatly attached on the outer surface of the elastic cylinder 1, they may have a good appearance. However, instant gripping force added on the club grip at the moment of striking a golf ball is very large, so the contacting line of two neighboring rounds of the cover 2 may be squeezed to tip up, resulting in an awkward untidy appearance and gradually shortened in its service life.

SUMMARY OF THE INVENTION

In view of the shortcomings of the conventional golf club grip, this invention has been devised to offer a golf club grip having a good tactile sense for gripping, a good anti-slipping effect and a variety in colors.

The feature of the invention is a golf club grip comprising:

a cylinder having an outer surface formed with a plurality of angled threads equally spaced from each other, each of the angled threads having an angled central thread body protruding outward from the outer surface of the cylinder, the angled central thread body of each of the angled threads having two sides each formed with an angled groove;

a plurality of anti-slipping hands each respectively wound around a respective one of the angled threads of the cylinder to surround the angled central thread body and the angled groove of the respective angled thread of the cylinder, each of the anti-slipping bands having two sides each extended outward from the respective angled thread of the cylinder and each rested on the outer surface of the cylinder; and a plurality of covers each respectively wound around the outer surface of the cylinder and each respectively located between two adjacent anti-slipping bands, each of the covers having two sides each rested on one of the two sides of a respective one of the two adherent anti-slipping bands:

the cylinder, the anti-slipping bands and the cover having colors different from each other.

BRIEF DESCRIPTION OF DRAWINGS

This invention may be better understood by referring to the accompanying drawings, wherein.

DETAILED DESCRIPTION OF THE PREFERRED EMBODIMENT

Figure 1:
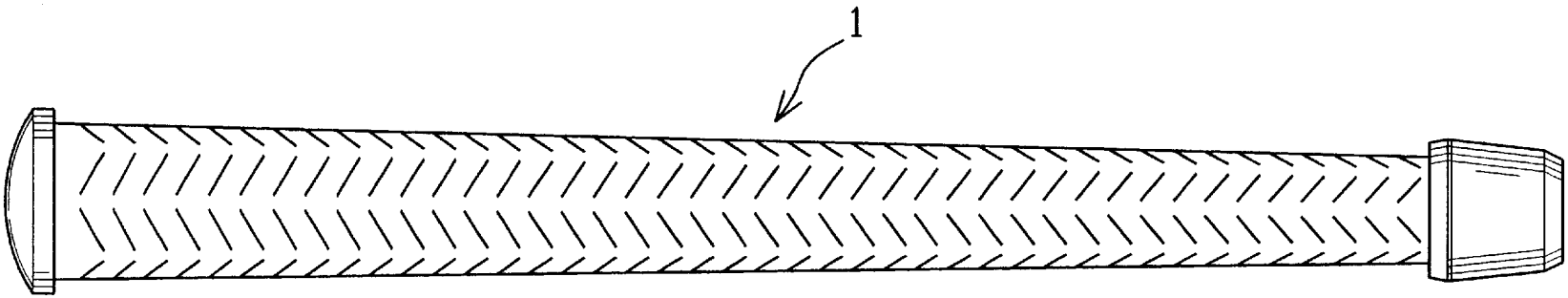
FIG. 1 (PRIOR ART)
FIG. 1 is a side view of a conventional golf club grip.
Figure 2:
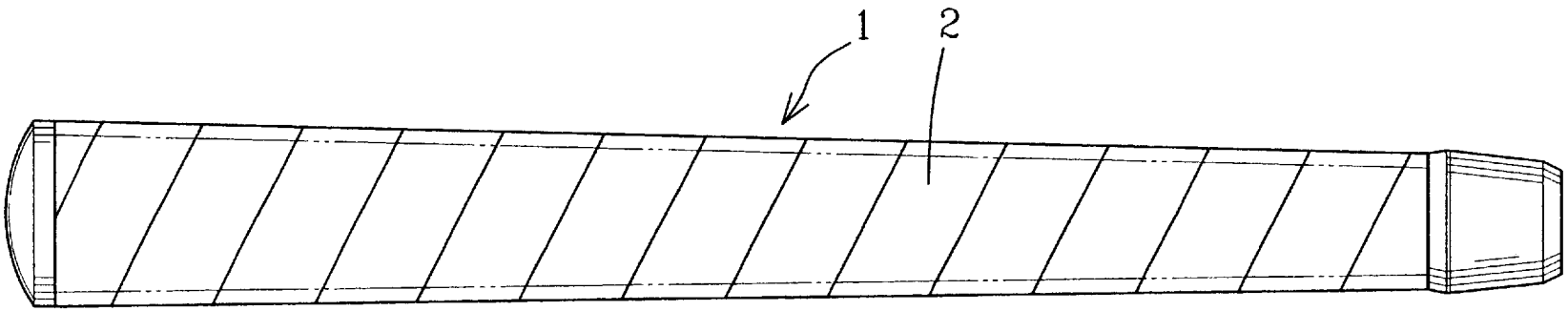
FIG. 2 (PRIOR ART)
FIG. 2 is side view of the conventional golf club grip wound around with a cover.
Figure 3:
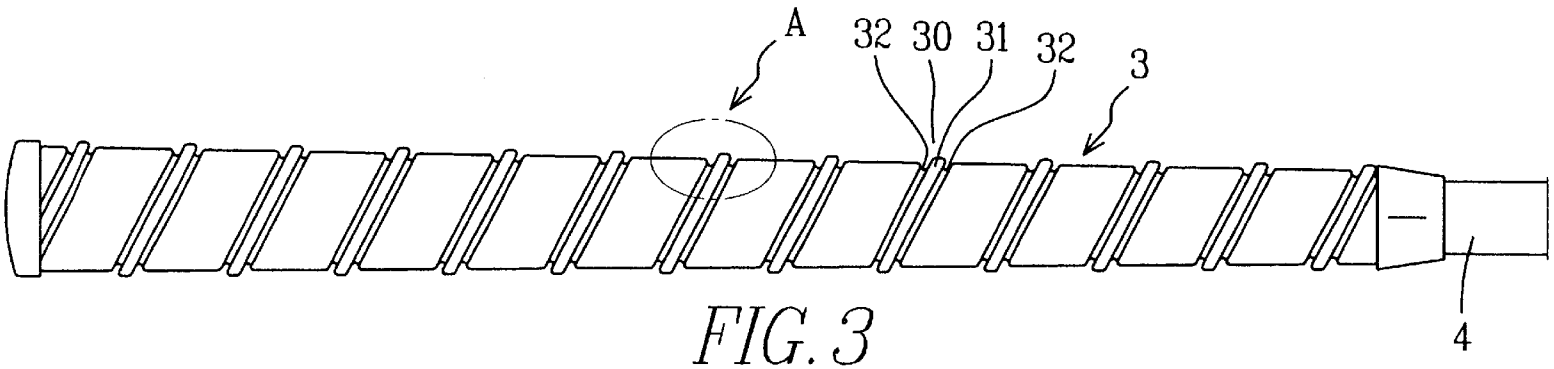
FIG. 3 is a side view of a cylinder of a golf club grip in the present invention.
Figure 4:
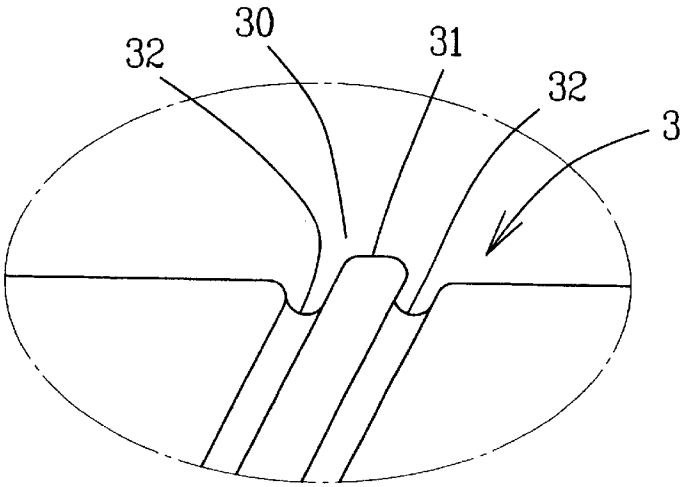
FIG. 4 is a magnified view of the part marked A in FIG. 3.
Figure 5:
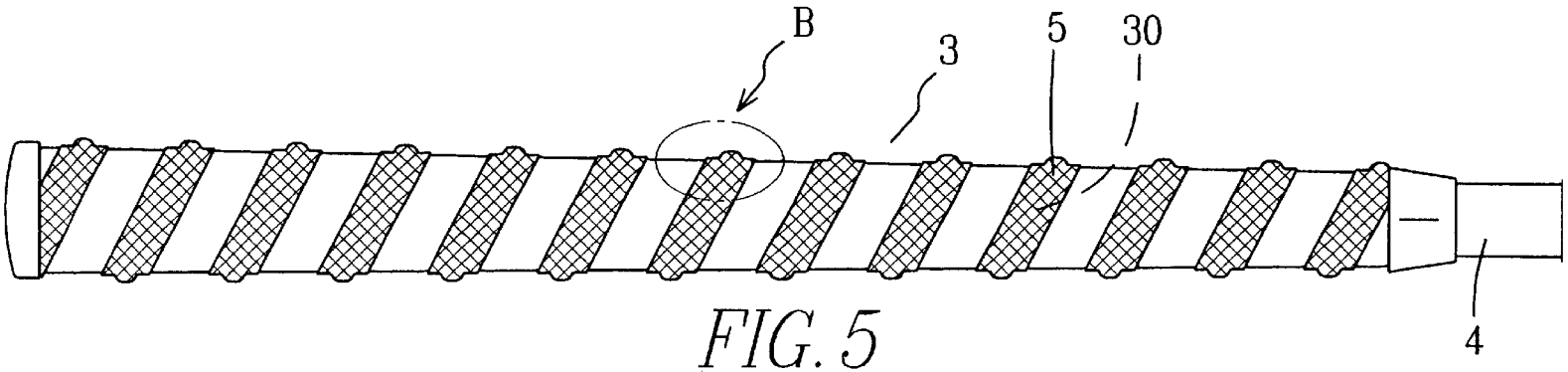
FIG. 5 is a side view of the golf club grip in the present invention, showing anti-slipping bands wound on the cylinder of the golf club grip in the present invention.
Figure 6:
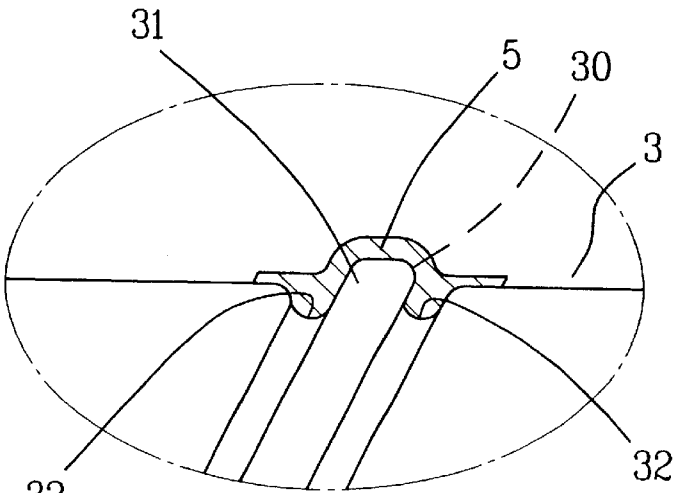
FIG. 6 is a magnified view of the part marked B in FIG. 5.
Figure 7:
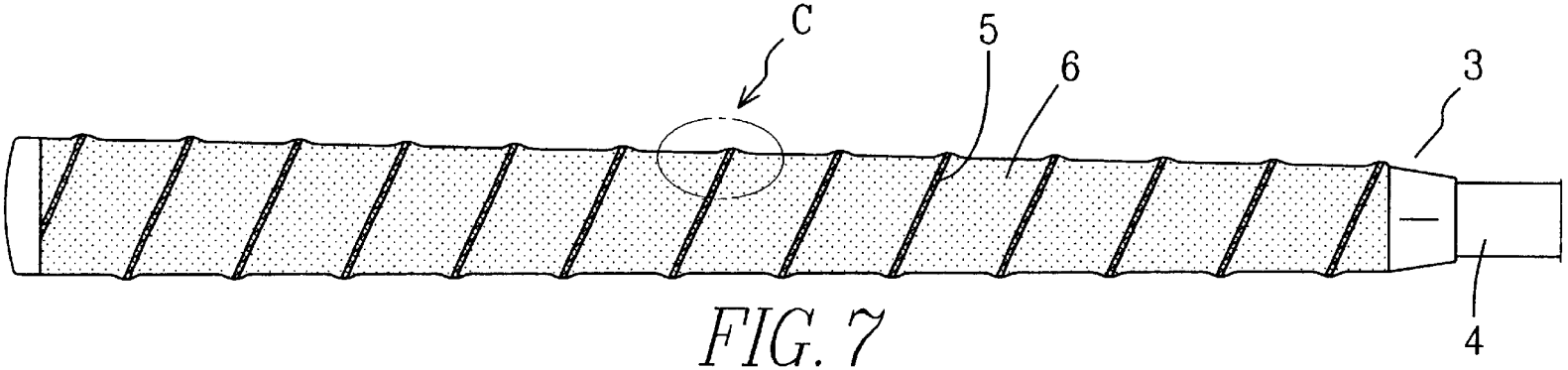
FIG. 7 is a side view of the golf club grip in the present invention, showing covers wound around the cylinder.
Figure 8:
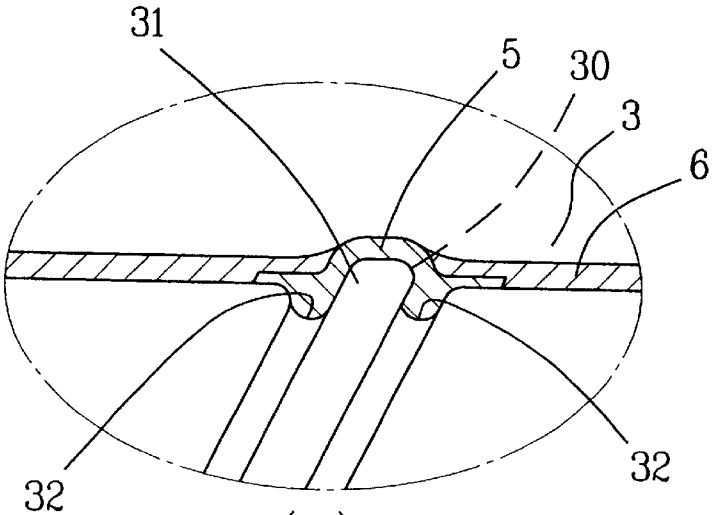
FIG. 8 is a magnified view of the part marked C in FIG. 7.

The preferred embodiment of a golf club grip in the present invention, as shown in FIGS. 3–8, includes a cylinder 3 to be fitted around on an upper portion of a golf club 4, and a plurality of angled separate threads 30 formed spaced apart equidistantly on an outer surface of the cylinder 3. A central thread body 31 is formed on each separate thread 30, and a groove 32 is formed at a right side and a left side of each thread body 31. A plurality of anti-slipping bands 5 shown in FIG. 5 are fixed around each separate thread 30. A plurality of covers 6 shown in FIG. 7 are respectively wound around each section defined by every two neighboring thread 30 on the cylinder 3.

The covers 6, the outermost layer of the club grip, are neatly and cleanly wound around the cylinder 3, respectively having the two opposite sides contact respectively every two neighboring threads 30, which extend upward a little higher than the outer surface of the cylinder 3. In other words, every two neighboring covers 6 are separated by one thread 30 definitely. Therefore, the covers 6 will never have two opposite sides pressed by the hands of a golfer to tip up obstructed by the threads 31 in case of the golf club striking a golf ball. Moreover, process of attaching the covers 6 on the cylinder 3 is quite simple and convenient.

Besides, when the cylinder 3, the anti-slipping bands 5 and the covers 6 are colored different from one another, the golf club grip may look much pretty, thanks to the various colors.

Figure 9:
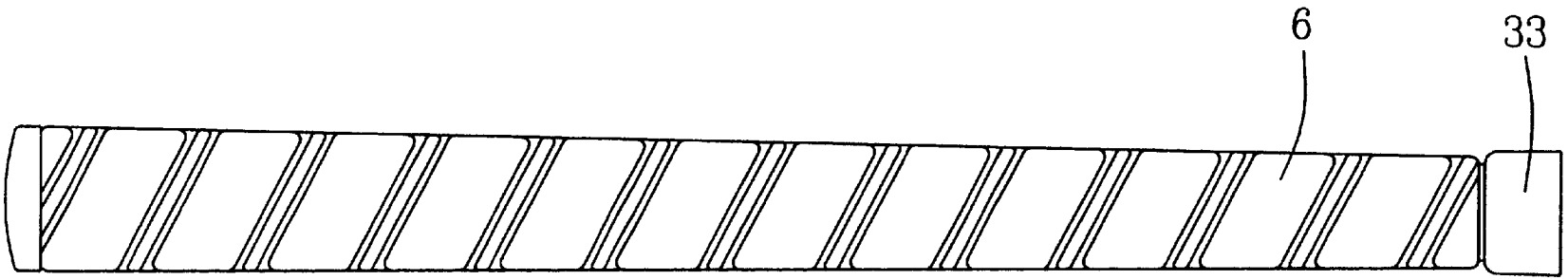
FIG. 9 is a side view of the golf club grip in the present invention, showing the outer end of the cylinder not folded inward for covering the outer ones of the covers; and, FIG. 10 is a side view of the golf club grip in the present invention, showing the outer end of the cylinder folded inward and covering on the outer ones of the cover.
Figure 10:
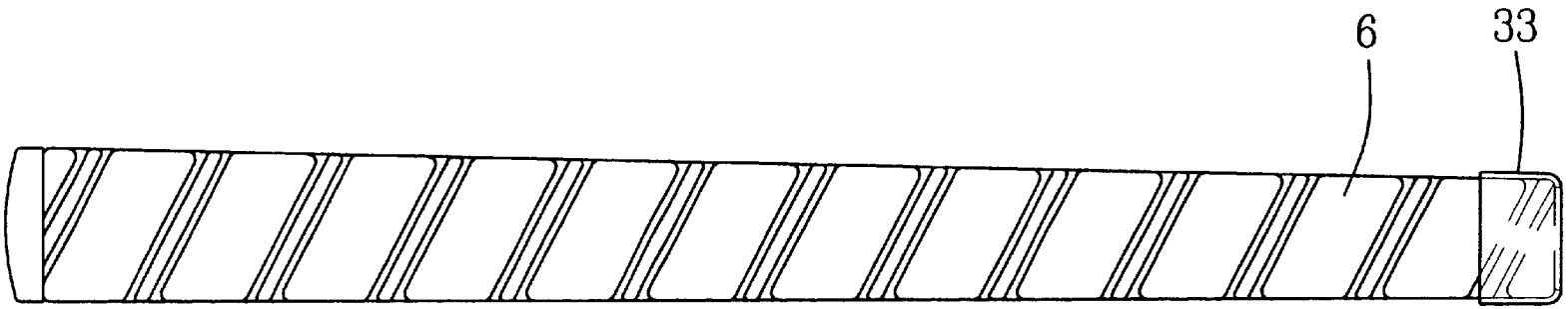

In addition, as shown in FIGS. 9 and 10, the outer end of the cylinder 3 can be designed to fold backward (or inward) to cover on the outer ones of the covers 6 after the whole covers 6 are wound around the cylinder 3 so as to keep the covers 6 firmly in place.

While the preferred embodiment has been described above, it will be recognized and understood that various modifications may be made therein and the appended claims are intended to cover all such modifications that may fall within the spirit and scope of the invention.

I claim:

1. A golf club grip comprising:

a cylinder having an outer surface formed with a plurality of angled threads equally spaced from each other, each of the angled threads having an angled central thread body protruding outward from the outer surface of the cylinder, the angled central thread body of each of the angled threads having two sides each formed with an angled groove;

a plurality of anti-slipping bands each respectively wound around a respective one of the angled threads of the cylinder to surround the angled central thread body and the angled groove of the respective angled thread of the cylinder, each of the anti-slipping bands having two sides each extended outward from the respective angled thread of the cylinder and each rested on the outer surface of the cylinder; and a plurality of covers each respectively wound around the outer surface of the cylinder and each respectively located between two adjacent anti-slipping bands, each of the covers having two sides each rested on one of the two sides of a respective one of the two adjacent anti-slipping bands;

the cylinder, the anti-slipping bands and the cover having colors different from each other.

* * * * *